United States Patent [19]

Otera et al.

[11] 4,126,567

[45] Nov. 21, 1978

[54] PERMANENT MAGNET COMPOSITES AND METHOD THEREFOR

[75] Inventors: Junzo Otera; Tsutomu Makimoto, both of Kurashiki; Wataru Shinoda; Norihisa Hattori, both of Hiroshima, all of Japan

[73] Assignees: Kuraray Co., Ltd., Japan; Toda Kogyo Corporation, Japan

[21] Appl. No.: 746,737

[22] Filed: Dec. 2, 1976

[30] Foreign Application Priority Data

| | | | |
|---|---|---|---|
| Dec. 2, 1975 | [JP] | Japan | 50-144269 |
| Dec. 2, 1975 | [JP] | Japan | 50-144270 |
| Sep. 24, 1976 | [JP] | Japan | 51-114904 |

[51] Int. Cl.[2] ..... H01F 1/34; H01F 1/37

[52] U.S. Cl. ..... 252/62.54

[58] Field of Search ..... 252/62.54, 62.63, 62.53

[56] References Cited

U.S. PATENT DOCUMENTS

| | | | |
|---|---|---|---|
| 2,849,312 | 8/1958 | Peterman | 252/62.54 X |
| 3,427,191 | 2/1969 | Howell et al. | 252/62.54 X |
| 3,428,603 | 2/1969 | Kroenke | 252/62.54 |
| 3,764,539 | 10/1973 | Cochardt et al. | 252/62.54 |
| 3,903,228 | 9/1975 | Riedl et al. | 264/108 |

OTHER PUBLICATIONS

I.O.S. Chemical Abstracts, vol. 83, Abstract 70575d, 1975.

*Primary Examiner*—F.C. Edmundson
*Attorney, Agent, or Firm*—Bacon & Thomas

[57] ABSTRACT

Permanent magnet composites comprising a cured liquid polymer matrix and hard magnetic ferrite particles dispersed therein are disclosed. The magnetic ferrite particles are present in an amount within the range of from about 5 to about 14 parts per part of polymer matrix, the magnetic ferrite particles having a general formula $MO.n\ Fe_2O_3$, wherein M is selected from the group consisting of barium, strontium, lead, and mixtures thereof, and $n$ has a value in the range of from about 4.5 to about 6.2. Various additives may optionally be employed to improve compatibility of the matrix polymer with the ferrite particles and to improve processibility. Also disclosed is a method for producing such magnetic composites.

12 Claims, 1 Drawing Figure

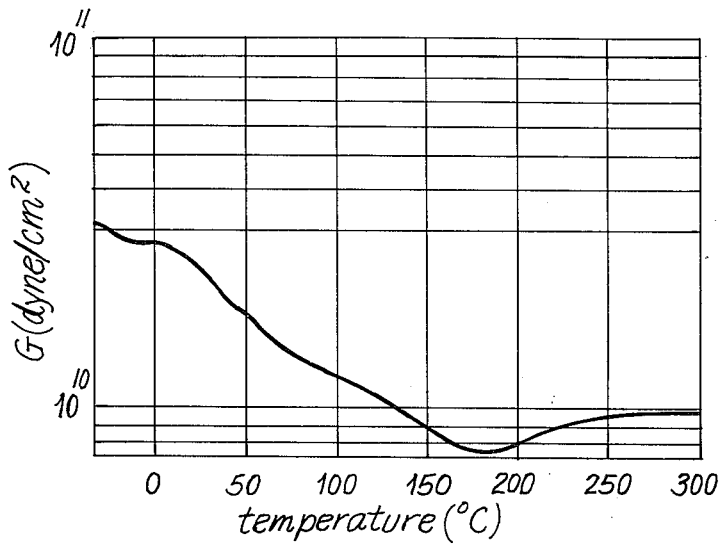
$10^{11}$
$10^{10}$
G(dyne/cm²)
0
50
100
150
200
250
300
temperature (°C)

PERMANENT MAGNET COMPOSITES AND METHOD THEREFOR

BACKGROUND OF THE INVENTION

1. Field of the Invention:

The present invention relates generally to magnetic composites comprising a polymer matrix having hard magnetic ferrite particles dispersed therein and, more especially, to magnetic composites exhibiting improved magnetic properties, useful for permanent magnets. The present invention also pertains to methods for producing such magnetic composites.

2. Description of the Prior Art:

The prior art recognizes magnetic composite bodies derived from rubber or plastic matrices charged with ferrite particles. Such magnets or magnetic compositions are disclosed in, for example, British Pat. No. 1,333,174 and No. 1,354,598, among others. As a generalization, these compositions are manufactured by kneading a ferrite powder with a solid polymer and, thence, forming the mixture by extrusion, calendering, or other mechanical working processes.

Magnetic bodies formed in accordance with these prior art techniques have been found superior to sintered ferrite magnets in terms of processibility, as well as flexibility and elasticity, thus rendering these varieties of magnetic bodies particularly suitable in a variety of applications predicated on such qualities. However, these prior art composites have been found to suffer a significant disadvantage inasmuch as they exhibit low magnetic forces precluding their use in applications requiring high magnetic characteristics. Also, thermal stability is observed to be poor, such composites suffering a loss of integrity upon prolonged exposure to temperatures in excess of about 100° C.

The magnetic energy of magnetic composites depends upon (1) the density or amount of ferrite per unit volume of the composite, and (2) the degree of orientation of ferrite particles within the matrix. Typically, where a ferrite powder is incorporated in a polymer, there is encountered an upper limit on the density or packing factor of the ferrite particulate. For example, where natural rubber is employed as the polymer matrix, it has been found impossible, as a practical matter, to incorporate the ferrite particulate in an amount greater than about 9 times the weight of the natural rubber. Additionally, the viscosity of the matrix compound is a significant determinant on the degree of orientation of the ferrite particles within the matrix, the two parameters being inversely proportional.

Accordingly, prior art composites are found to be deficient insofar as both the amount of magnetic ferrite particulate capable of incorporation and the degree of orientation thereof are restricted to limits considered inferior for numerous applications wherein the flexibility of these composites would otherwise prove highly beneficial. Additionally, lack of thermal stability further restricts their utility. Therefore, the need exists to provide magnetic composites, and a method therefor, which overcomes these manifest deficiencies in the prior art.

SUMMARY OF THE INVENTION

It is, therefore, a primary object of the present invention to provide a new magnetic composite body which exhibits high magnetic energy and is, thus, highly adapted for application as a permanent magnet.

Another object of the present invention is to provide a magnetic composite which is comprised of a polymeric matrix within which is dispersed a greater quantity of hard ferrite particulate than has heretofore been attainable in similar articles.

Yet a further object of the present invention is to provide a magnetic composite wherein the degree of orientation of magnetic ferrite particles is improved over similar magnetic composites.

Still a further object of the present invention is to provide a magnetic composite exhibiting improved thermal stability.

Yet a further object of the present invention is to provide a method for producing an improved magnetic composite comprising a polymeric matrix having dispersed therein hard magnetic ferrite particulate, which is present in greater quantities and which particles exhibit a greater degree of orientation than heretofore attainable in similar processes.

In accordance with the objects and advantages of the present invention, it has been determined that improved magnetic composites may be comprised of a polymeric matrix having hard magnetic ferrite particles dispersed therein. The polymeric matrix is based on a liquid rubber having a viscosity within the range of from about $10^3$ to about $10^6$ cps (Brookfield viscosity at 25° C). The magnetic ferrite particles are described by the general formula $MO.n\ Fe_2O_3$; wherein M is selected from the group consisting of Ba, Sr, Pb, and mixtures thereof, and $n$ has a value in the range of from about 4.5 to about 6.2. The ratio of the liquid rubber matrix to the ferrite particulates is within the range of from about 1–5 to about 1–14 by weight.

Various additives may also be present in order to improve both the magnetic characteristics of the composite as well as the processibility thereof. Accordingly, it is preferred that one or more dispersion-effective polar organic compounds, capable of interaction with the surfaces of the ferrite particulates, be present. The preferred polar organic compounds for this purpose are those selected from the group consisting of aldehydes, ketones, carboxylic acid ester compounds, amines, epoxy compounds, and other functionally-effective chemical compounds. The polar organic compounds are added to be present within the range of from about 0.1 to about 5 weight percent based upon the weight of the ferrite particulates.

Additionally, other beneficial additives are comprised of stearic acid or a metal salt thereof, present within the range of from about 0.05 to about 0.5 weight percent based upon the weight of the ferrite particulates. These additives are useful for tailoring the viscosity of the polymer matrix and, thus, other functionally-effective compounds might be employed to this end.

BRIEF DESCRIPTION OF THE DRAWING

The sole FIGURE of drawing graphically illustrates the relationship between temperature and stability (in terms of rigidity) of a cured composite magnet comprised of a liquid polybutadiene and a barium ferrite made in accordance with the present invention.

DETAILED DESCRIPTION OF THE INVENTION

The present invention pertains generally to magnetic composites comprised of a polymer matrix having dispersed therein a quantity of hard magnetic ferrite particulates. The polymer matrix is based upon various liquid rubbers, and may be selected from a large variety of effective chemical compounds. The hard magnetic ferrite particles are represented generally by the formula $MO.n\ Fe_2O_3$; wherein M is selected from the group consisting of barium, strontium, lead, and mixtures thereof; and, *n* has a value of between about 4.5 and about 6.2. Various additives to improve the compatibility of the ferrite particles with the polymer matrix, thus improving the relative amount of particulate which may be dispersed in the matrix, or additives to tailor the viscosity of the polymer may, preferably, be present.

In order to more fully elucidate upon the various objects and advantages of the present invention, the following detailed description will be given in terms of various preferred embodiments and exemplified with respect thereto. However, this is intended to be illustrative and in no wise limitative.

The polymeric matrix of the present invention is based on a liquid rubber and may be selected from the liquid polybutadiene, liquid polyisoprene, liquid polyisobutylene, and the corresponding liquid copolymers thereof, as well as such polymers modified by hydroxyl, carboxyl, maleic anhydride, isocyanate, acryl, and other similar groups. Blended matrices comprised of the aforementioned liquid polymers and liquid polymers containing a small amount of a solid rubber are also envisioned within the scope of the present invention.

It has been determined that the viscosity of the liquid polymer matrix must be within the range of from about $10^3$ to about $10^6$ cps (Brookfield viscosity at 25° C), and preferably within the range of from about $5 \times 10^3$ to about $5 \times 10^5$ cps. As will be more fully described hereinbelow, various additives may be incorporated to properly tailor the viscosity of the polymer matrix.

For ease of explanation, the invention will be described with particular reference to liquid polybutadiene polymers. However, the skilled artisan will appreciate that this manner of illustration is not limitative of the scope of the invention.

The liquid polybutadiene rubber employed must have an average molecular weight within the range of from about 1,000 to about 10,000. Should the molecular weight of the polymer be less than about 1,000, the chain length will be too short to yield an effective binder or matrix for the ferrite particles incorporated therein. On the contrary, polybutadiene having an average molecular weight in excess of about 10,000 results in an excessively high viscosity rendering the compound untoward for molding purposes.

The ferrite particulate incorporated within the polymer matrix in accordance with the present invention is preferably a high magnetic energy oxide having an hexagonal crystalline lattice. Exemplary of such preferred ferrites are the powdery oxides having the structures $BaO.6\ Fe_2O_3$, $SrO.6\ Fe_2O_3$, or $PbO.6\ Fe_2O_3$. Regardless of the ferrite particulate employed, the powder must be readily dispersible or blendable with the liquid rubber matrix selected. To facilitate these requirements, the ferrite particles are preferably in the form of plates having an average particle diameter within the range of from about 1 to about 3 microns.

To yield a composite having improved magnetic characteristics, the ratio of ferrite particles to liquid rubber matrix is preferably as high as possible. For example, when liquid polybutadiene is employed as the liquid rubber matrix, the preferred ratio is about 5 to about 14 parts by weight of ferrite for each part of liquid rubber. Where the proportion of ferrite is less than about 5 parts, the resultant magnetic composite does not exhibit a magnetic energy on a practically useful order, in terms of the applications envisioned for composites produced in accordance with the present invention. Contrariwise, composites containing more than about 14 parts of ferrite are difficult to work because of a high resultant viscosity which significantly restricts moldable flow, processibility, and the degree of orientation of the ferrite particles.

The incorporation of ferrite particles within the liquid rubber may be effected by any routine compounding or blending procedure. Consequently, considerable advantages in processing the composition of matter of the present invention are presented over the prior art blending of ferrite with natural or other solid rubbers, which may be accomplished only by means of a mixing roll. Thus, where natural rubber and ferrites are blended on a conventional mixing roll, the compound will detach from the roll if the ratio of ferrite to natural rubber exceeds about 9 to 1, by weight, thus severely restricting the upper limit of magnetic energy attainable. Where a liquid rubber is employed, the incorporation of ferrite may be accomplished by, for example, a screw-type mixer. Consequently, the impregnation of matrix rubber with ferrite is possible within the mechanical limits of the load on the mixer. In other words, a greater amount of ferrite may be incorporated with the liquid rubber than is possible with solid rubbers.

In order to further improve the amount of ferrite particulate capable of incorporation, various dispersion-effective, polar organic compound additives are preferably present. These polar organic compounds are capable of interacting with the ferrite particulate surfaces to enhance the affinity of the particulate for the liquid rubber, thus making it feasible to impregnate the rubber matrix with up to about 14 times its weight with the ferrite, while concomitantly insuring an adequate degree of moldability. Without the addition of such polar organic compounds, it has been found that the amount of ferrite which may be added is restricted to less than about 10 times that of the liquid rubber, by weight, and yet yield satisfactory processibility of the composite mass.

Not only is processibility improved by the addition of these polar organic compounds, the degree of orientation of ferrite particles is likewise improved due to the reduction in viscosity of the matrix composition resulting from the presence of these additives. For example, whereas the plastographic torque for mixing 9 weight parts of barium ferrite with each weight part of liquid polybutadiene (average molecular weight 4,000), in the absence of a polar organic compound, is 130 kg.cm, the corresponding torque of a similar mass having incorporated therein 0.5 weight percent of methyl oleate, based on the ferrite, is as low as 75 kg.cm.

Among the polar organic compounds exhibiting the desired interactive properties with respect to the ferrite particle surfaces are included a variety of compounds such as carbonyl compounds, carboxylic acid esters, amines, epoxy compounds, and other functionally-effective chemical compounds. More particularly, exemplary of the carbonyl compounds are aldehydes (e.g., n-butylaldehyde, benzaldehyde, etc.) and ketones (e.g., diisopropyl ketone, methylethyl ketone, etc.). Illustrative of beneficial carboxylic acid esters are methyl laurate, methyl oleate, and the like. The useful amines include tri-n-butylamine, hexamethylene diamine, laurylamine, etc., while the epoxy compounds such as epichlorohydrin, propyleneoxide, etc., have been found particularly useful. These polar organic compounds may be added in a single dose at the time of compounding; however, since the additive effect will be more pronounced if the ferrite particles are previously treated with a portion or all of a necessary amount, such pretreatment is preferred. The appropriate treatment of the ferrite particles with the polar organic compound may be made in any of a number of known methods including gas-phase or liquid-phase treatment. Regardless of the manner or time of treatment, the proportion of the polar organic compound is preferably within the range of from about 0.1 to about 5.0 weight percent based upon the weight of the ferrite powder. Additions of less than 0.1 percent yield no tangible effects while additions in excess of 5.0 weight percent detract from the mechanical strength of the composition and also result in "bleeding", manifested as a tacky surface.

In addition to the beneficial results obtained by additions of the afore-mentioned polar organic compounds, which result in a greater compatibility of the ferrite particulate with the liquid rubber matrix, it has been found that various other additives may be incorporated to further modify the properties of the magnetic composite. Accordingly, it is particularly advantageous to provide additions of stearic acid, or a metallic salt thereof, within the range of from about 0.05 to about 0.5 weight percent based upon the weight of the ferrite particles. Such additions of stearic acids result in a significant reduction in the viscosity of the compound which, in turn, leads to improvement in both processibility and degree of orientation of the ferrite particles in the magnet. Thus, as a result of improved orientation, the article exhibits significantly improved magnetic properties.

For example, in compounding liquid polybutadiene (average molecular weight 4,000) with 9 times its weight of barium ferrite, which has been previously surface-treated with 0.5 weight percent methyl oleate (based on the weight of the ferrite), the plastographic torque is 75 kg.cm in the absence of the stearic component. However, addition of 0.2 weight percent of zinc stearate, based on the ferrite, reduces the torque to 37 kg.cm and, simultaneously, increases the $(B.H)_{max}$ value of the magnet resulting from the process by about 10 to 20 percent.

The effect of stearate additions is both separate and distinct from that flowing as a consequence of the polar organic compound additions. For example, further addition of 0.2 to 0.5 weight percent, based on the weight of the ferrite, of a polar organic compound such as methyl oleate or tri-n-butylamine, in lieu of the stearic acid or metallic salt thereof, does not lower the torque nor improve the $(B.H)_{max}$ value of the resulting magnet.

There is no particular criticality regarding the type of metal salt of the stearic acid employed. Accordingly, sodium, potassium, barium, magnesium, calcium, zinc, aluminum, lead, and the like are equally efficacious. Irrespective of the source of stearate, it is preferable that the level of addition be within the range of 0.05 to 0.5 weight percent based upon the weight of the ferrite in the composition of matter No effect will be realized where the stearic compound is less than 0.05 weight percent while, contrariwise, the subsequent cross-linking action of the process of the present invention is substantially inhibited when the level of the stearates exceeds 0.5 weight percent.

The compounding process whereby the ferrite powder is dispersed within the liquid rubber may be accomplished by any one of a number of known mixing techniques conventionally employed in the molding of plastics. This fact imports a significant advantage, processwise, over the compounding of natural or other solid rubbers with ferrite which necessitates roll mixing as the only feasible process.

The compound of the present invention may be readily cured into a shape-sustaining body by the incorporation of a cross-linking or vulcanizing agent at the time of compounding. Should it be necessary, utilizing a suitable curing agent will result in a flexible, cross-linked product. Moreover, when curing is conducted within the influence of a magnetic field, the orientation of the ferrite particles within the composite are substantially improved. The resultant compound is then fed to an injection, extrusion, compression, or other molding apparatus, or to a calender, for appropriate formation into a desired shaped article.

The composite magnetic body according to the present invention is adapted for a wide range of applications by suitably varying the ratio of ferrite to liquid rubber. Thus, where the ratio of ferrite to liquid rubber is comparatively low, the composite body may be employed as a refrigerator door gasket, or for similar applications currently within the scope of utility of conventional rubber magnets. On the contrary, magnet bodies incorporating a high ferrite-liquid rubber ratio and having a $(B.H)_{max}$ value in excess of 0.9 MG.Oe might be utilized as a substitute for isotropic sintered magnets employed in micromotors, and the like; applications where conventional rubber magnets have heretofore proved unsuitable due to inferior magnetic energies.

An additional feature extending the utility of the magnetic body according to the present invention is excellent heat resistance (thermal stability). Conventional composites, having a natural rubber matrix, are incapable of prolonged service at temperatures exceeding about 100° C. However, the composites of the present invention, employing a liquid polybutadiene or other equivalent compounds as a matrix, appropriately molded and cured, exhibit a rigidity of $10^{10}$ dyne/cm$^2$ even at 300° C. Flexural strength data, obtained from high temperature testing, demonstrate the ability of the instant composites to withstand continuous service at 120° C, a significant improvement over prior art devices.

The following examples are given to further illustrate the present invention without delimiting its scope in any manner.

EXAMPLES 1 to 13

A liquid polybutadiene, with an average molecular weight of 4,000 (NISSO PB-4000, a butadiene homopolymer available from Nippon Soda Co., Ltd.), or a hydroxy-terminated liquid polybutadiene with an average molecular weight of 3,000 (NISSO PBG-3000, a hydroxy-terminated polybutadiene available from Nippon Soda Co., Ltd.) was compounded with ferrite powder in various predetermined proportions. The ferrite powder was prepared by admixing iron oxide and barium carbonate in a $Fe_2O_3$/BaO mole ratio of 5.75/1 and the mixture was calcined at 1,150° C. Subsequently, the mixture was milled to about 1.4 microns in diameter. Alternatively, iron oxide and strontium carbonate were similarly admixed in a $Fe_2O_3$/SrO mole ratio of 5.75/1 and the mixture was calcined at 1,200° C, followed by milling to about 1.2 microns. These mixtures were each compounded in a Brabender mixer (the sigma blade mixer unit of the Brabender Plastograph) at room temperature and with a rotor speed of 20 r.p.m. for 5 minutes. The resultant compound was pressed at room temperature under a pressure of 50 kg/cm$^2$ in a magnetic field of 5,000 or 10,000 oersteds for 3 minutes to prepare a sample plate. The $(B.H)_{max}$ value and Br/ferrite/cm$^3$ value of ferrite particles of the samples are set forth in Table 1, together with the corresponding data for prior art products. The Br/ferrite/cm$^3$ value represents the degree of orientation of ferrite particles, as expressed by the Br value displayed by the ferrite in unit volume of the body. Table 1 also tabulates the data for prior art magnetic bodies based on a natural rubber matrix.

TABLE 1

| Example | Matrix | Ferrite | Particle diam. of ferrite (μ) | Magnetic field (Oe) | Ferrite/matrix (weight ratio) | $(B \cdot H)_{max}$ (MG · Oe) | Br/Ferrite/cm$^3$ (G/g/cm$^3$) |
|---|---|---|---|---|---|---|---|
| 1 | PB-4000 | $Fe_2O_3$/BaO | 1.4 | 5,000 | 5 | 0.62 | 688 |
| 2 | " | | " | " | 6 | 0.70 | 699 |
| 3 | " | | " | " | 7 | 0.76 | 698 |
| 4 | " | | " | " | 8 | 0.80 | 685 |
| 5 | " | | " | " | 9 | 0.85 | 660 |
| 6 | " | | " | " | 10 | 0.88 | 642 |
| 7 | PBG-3000 | | " | " | 8 | 0.77 | 662 |
| 8 | " | | " | " | 9 | 0.81 | 655 |
| 9 | " | | " | " | 10 | 0.88 | 646 |
| 10 | PBG-4000 | $Fe_2O_3$/SrO | 1.2 | 10,000 | 7 | 0.95 | |
| 11 | " | | " | " | 8 | 0.99 | |
| 12 | " | | " | " | 9 | 1.05 | |
| 13 | " | | " | " | 10 | 1.03 | |
| Control Example 1 | Natural rubber | $Fe_2O_3$/BaO | 1.4 | 5,000 | 9 | 0.80 | 609 |
| Control Example 2 | " | $Fe_2O_3$/SrO | 1.2 | 10,000 | 9 | 0.85 | |

EXAMPLE 14

The procedure of Example 5 was repeated except that, based on 100 weight parts of PB-4000, 2 weight parts of dicumyl peroxide was added at the time of compounding the mixture, and the resultant compound was then pressed at 150° C for 3 hours. The resultant, cured, shaped article exhibited satisfactory rigidity, even at 300° C, as illustrated in the FIGURE. Also, as shown in Table 2, the article retained a residual flexural strength of 72.8%, even after being exposed to air and maintained at 120° C for a period of 4 weeks.

TABLE 2

| | 0 | After 1 week | After 2 weeks | After 4 weeks |
|---|---|---|---|---|
| Flexural strength (kg/cm$^2$) | 353 | 349 | 342 | 257 |
| Retention (%) | 100 | 98.9 | 97.1 | 72.8 |

EXAMPLE 15

In a plastograph, 12 g of liquid polybutadiene with an average molecular weight of 6,200 (Polyoil 160, a butadiene homopolymer available from Nippon Zeon), 120 g of the same barium ferrite powder as used in Example 1, and 0.24 g of dicumyl peroxide were compounded at room temperature at a mixer speed of 20 r.p.m. The batch was then pressed at 150° C under a pressure of 50 kg/cm$^2$ for 5 hours in a magnetic field of 5,000 oersteds to obtain a cross-linked body. The $(B.H)_{max}$ of this body was 0.86 MG.Oe.

EXAMPLE 16

In a plastograph, the following mixture was compounded at room temperature and 20 r.p.m.

| | |
|---|---|
| Polyoil 160 | 12g |
| Barium ferrite (same as used in Example 1) | 120g |
| Sulfur | 0.96g |
| Activated zinc oxide | 0.60g |
| Stearic acid | 0.12g |
| Nocceler DM (cure accelerator)[1] | 0.12g |
| Nocceler H (cure accelerator)[2] | 0.04g |
| Noclac NS 6 (aging inhibitor)[3] | 0.12g |

[1]Dibenzothiazyldisulfide available from Ouchi Shinko Corp.
[2]Hexamethylene tetramine available from Ouchi Shinko Corp.
[3]2,2'-Methylene bis(4-methyl-6-tert-butylphenol) available from Ouchi Shinko Corp.

This mixture was pressed at 150° C and 50 kg/cm$^2$ for 5 hours in a magnetic field of 5,000 oersteds to obtain a vulcanizate. The $(B.H)_{max}$ of this vucanizate was 0.89 MG.Oe.

EXAMPLES 17–33 One kg of ferrite powder, prepared in the same manner as Examples 1 to 13, was heated together with 20 g of methyl oleate at 180° C, under stirring, for 1 hour. The resultant barium or strontium ferrite particles, thus pre-treated with methyl oleate, were employed in samples corresponding to Examples 17–33 prepared as outlined below.

Using a Brabender Plasograph, a butadiene homopolymer with an average molecular weight of 4,000 (NISSO PB-4000, available from Nippon Soda), or a hydroxyl-terminated polybutadiene with an average molecular weight of 3,000 (NISSO PBG-3000, available from Nippon Soda), was blended with the methyl oleate-treated ferrites in various predetermined weight proportions at room temperature and 20 r.p.m. Each of the mixtures thus obtained was pressed at 50 kg/cm$^2$ in a magnetic field at room temperature for 3 minutes. The magnetic values of the resultant shaped articles are given in Table 3.

TABLE 3

| Example | Matrix | Ferrite | Particle diam. of ferrite (μ) | Magnetic field (Oe) | Ferrite/matrix (weight ratio) | $(B \cdot H)_{max}$ (MG · Oe) | Br/Ferrite/cm$^3$ (G/g/cm$^3$) |
|---|---|---|---|---|---|---|---|
| 17 | PB-4000 | $Fe_2O_3$/BaO | 1.4 | 5,000 | 9 | 0.90 | 678 |

TABLE 3-continued

| Example | Matrix | Ferrite | Particle diam. of ferrite (μ) | Magnetic field (Oe) | Ferrite/ matrix (weight ratio) | $(B \cdot H)_{max}$ (MG · Oe) | Br/Ferrite/ $cm^3$ ($G/g/cm^3$) |
|---|---|---|---|---|---|---|---|
| 18 | " | " | " | " | 10 | 0.92 | 661 |
| 19 | " | " | " | " | 11 | 0.94 | 614 |
| 20 | " | " | " | " | 12 | 0.94 | 562 |
| 21 | " | " | " | " | 14 | 0.93 | 548 |
| 22 | PBG-3000 | " | " | " | 9 | 0.83 | 648 |
| 23 | " | " | " | " | 10 | 0.92 | 660 |
| 24 | " | " | " | " | 11 | 0.92 | 600 |
| 25 | " | " | " | " | 12 | 0.90 | 562 |
| 26 | " | " | " | " | 14 | 0.88 | 550 |
| 27 | PB-4000 | $Fe_2O_3$/SrO | 1.2 | 10,000 | 7 | 1.00 | |
| 28 | " | " | " | " | 8 | 1.06 | |
| 29 | " | " | " | " | 9 | 1.15 | |
| 30 | " | " | " | " | 10 | 1.15 | |
| 31 | " | " | " | " | 11 | 1.10 | |
| 32 | " | " | " | " | 12 | 1.07 | |
| 33 | " | " | " | " | 14 | 1.03 | |

EXAMPLES 34–43

Barium ferrite and strontium ferrite, treated with methyl oleate in the same manner as Examples 17–23, were employed in samples corresponding to Examples 34–43, prepared as outlined below.

In a Brabender Plastograph, a butadiene homopolymer with an average molecular weight of 4,000 (NISSO PB-4000, avilable from Nippon Soda), a varying amount of methyl oleate-treated ferrite particles, 0.2 weight percent of zinc stearate (based on the weight of the ferrite particles), and 3 weight percent of tertiary butyl peroxybenzoate (Perbutyl Z, a cross-linking agent available from Nippon Yushi) (based on the polybutadiene), were compounded at 70° C and 20 r.p.m. The resultant compound was pressed in a magnetic field at 180° C under a pressure of 50 kg/$cm^2$ for 5 minutes. The magnetic values of the shaped articles thus obtained are shown in Table 4, and are contrasted with data for similar articles obtained without a stearate (Control Examples 1 to 5).

TABLE 4

| Example | Ferrite | Particle diam. of ferrite (μ) | Magnetic field applied (Oe) | Ferrite/ matrix (weight ratio) | Zinc stearate | $(B \cdot H)_{max}$ (MG · Oe) |
|---|---|---|---|---|---|---|
| 34 | $Fe_2O_3$/BaO | 1.4 | 5,000 | 9.0 | Added | 1.0 |
| 35 | " | " | " | 9.5 | " | 1.1 |
| 36 | " | " | " | 10.0 | " | 1.0 |
| 37 | " | " | " | 10.5 | " | 1.05 |
| 38 | " | " | " | 11.0 | " | 1.03 |
| 39 | $Fe_2O_3$/SrO | 1.2 | 10,000 | 8.5 | " | 1.23 |
| 40 | " | " | " | 9.0 | " | 1.30 |
| 41 | " | " | " | 9.5 | " | 1.25 |
| 42 | " | " | " | 10.0 | " | 1.25 |
| 43 | " | " | " | 10.5 | " | 1.20 |
| Control Example 1 | $Fe_2O_3$/BaO | 1.4 | 5,000 | 9.0 | Not added | 0.90 |
| 2 | " | " | " | 9.5 | " | 0.90 |
| 3 | " | " | " | 10.0 | " | 0.92 |
| 4 | $Fe_2O_3$/SrO | 1.2 | 10,000 | 8.5 | " | 1.17 |
| 5 | " | " | " | 9.0 | " | 1.15 |

With the use of 0.7 weight percent of aluminum stearate relative to ferrite, pressing at 180° C under a pressure of 50 kg/$cm^2$ for 30 minutes did not cause the curing reaction to proceed to an adequate extent, failing to yield satisfactory shaped articles.

While the invention has now been described in terms of various preferred embodiments, and exemplified with respect thereto, the skilled artisan will appreciate that yet other modifications, substitutions, changes, and omissions may be made without departing from the spirit therof. Accordingly, the scope of the present invention is intended to be limited solely by that of the following claims.

What is claimed is:

1. A composition of matter curable into a permanent, high-energy magnetic composite exhibiting improved high temperature thermal stability, comprising:

(a) a cross-linkable liquid rubber compound selected from the group consisting of liquid polybutadiene, liquid polyisoprene, liquid polyisobutylene, the corresponding liquid copolymers, and such polymers modified by hydroxyl, carboxyl, maleic anhydride, isocyanate, and acryl groups, said compound having a Brookfield viscosity at 25° C in the range of from about $5 \times 10^3$ to about $5 \times 10^5$ cps; and (b) a particulate of a magnetic ferrite of the general formula MO.n $Fe_2O_3$; wherein M is selected from the group consisting of Ba, Sr, Pb, and mixtures thereof; and *n* has a value in the range of from about 4.5 to about 6.2, said particulate present within the range of from about 5 to about 14 parts per part of said liquid rubber compound.

2. The composition of matter of claim 1, further comprising a dispersion-effective, polar organic compound capable of interaction with said particulate for improving compatibility thereof with said liquid rubber compound, said polar organic compound present within the range of from about 0.1 to about 5.0 percent relative to the weight of said particulate, wherein said polar organic compound is selected from the group consisting of n-butylaldehyde, benzaldehyde, diisopropyl ketone, methyl ethyl ketone, methyl laurate, methyl oleate, tri-n-butylamine, hexamethylene diamine, laurylamine, epichlorohydrin, and propylene oxide.

3. The composition of matter of claim 2, further comprising a viscosity modification-effective compound selected from the group consisting of stearic acid and metallic salts thereof, present within the range of from about 0.05 to about 0.5 percent relative to the weight of said particulate.

4. The composition of matter of claim 3, further comprising an effective amount of a cross-linking or vulcanizing agent.

5. The cured magnetic composite of claim 4.

6. The composition of matter of claim 2, further comprising an effective amount of a cross-linking or vulcanizing agent.

7. The cured magnetic composite of claim 6.

8. The composition of matter of claim 1, further comprising an effective amount of a cross-linking or vulcanizing agent.

9. The cured magnetic composite of claim 8.

10. A method for producing a permanent, high-energy magnetic composite exhibiting improved high temperature thermal stability, comprising the step of mixing a cross-linkable liquid rubber compound selected from the group consisting of liquid polybutadiene, liquid polyisoprene, liquid polyisobutylene, the corresponding liquid copolymers, and such polymers modified by hydroxyl, carboxyl, maleic anhydride, isocyanate, and acryl groups, said compound having a Brookfield viscosity at 25° C in the range of from about $5 \times 10^3$ to about $5 \times 10^5$ cps with from about 5 to about 14 parts of a particulate magnetic ferrite, relative to the weight of said liquid rubber compound, said ferrite having a general formula of $MO.n\ Fe_2O_3$; wherein M is selected from the group consisting of Ba, Sr, Pb, and mixtures thereof, and *n* has a value in the range of from about 4.5 to about 6.2, and thence curing said mixture to form a permanent, high-energy magnetic composite.

11. The method of claim 10, further comprising the step of adding a dispersion-effective, polar organic compound capable of interaction with said particulate for improving compatibility thereof with said liquid rubber compound, said polar organic compound being added within the range of from about 0.1 to about 5.0 percent relative to the weight of said particulate, wherein said polar organic compound is selected from the group consisting of n-butylaldehyde, benzaldehyde, diisopropyl ketone, methyl ethyl ketone, methyl laurate, methyl oleate, tri-n-butylamine, hexamethylene diamine, laurylamine, epichlorohydrin, and propylene oxide.

12. The method of claim 9, further comprising the step of adding a viscosity modification-effective compound to the mixture of said liquid rubber and said particulate, said viscosity modification-effective compound being either stearic acid or a metallic salt thereof added within the range of from about 0.05 to about 0.5 percent relative to the weight of said particulate.

* * * * *